United States Patent [19]

Leonardi et al.

[11] Patent Number: 4,473,337

[45] Date of Patent: Sep. 25, 1984

[54] BLADE DAMPER SEAL

[75] Inventors: Salvatore A. Leonardi; C. Paul Redington, both of Glastonbury, Conn.

[73] Assignee: United Technologies Corporation, Hartford, Conn.

[21] Appl. No.: 358,136

[22] Filed: Mar. 12, 1982

[51] Int. Cl.[3] ..... F01D 5/10

[52] U.S. Cl. ..... 416/193 A; 416/500

[58] Field of Search ..... 416/193 A, 190, 191, 416/500

[56] References Cited

U.S. PATENT DOCUMENTS

| | | | |
|---|---|---|---|
| 3,112,915 | 12/1963 | Morris | 416/193 A X |
| 3,266,771 | 8/1966 | Morley | 416/190 |
| 3,295,825 | 1/1967 | Hall | 415/172 A X |
| 3,610,778 | 10/1971 | Suter | 416/193 A X |
| 3,709,631 | 1/1973 | Karstensen et al. | 416/193 A X |
| 3,841,792 | 10/1974 | Amos | 415/172 A |
| 3,887,298 | 6/1975 | Hess et al. | 416/95 X |
| 3,936,222 | 2/1976 | Asplund et al. | 416/95 |
| 4,101,245 | 7/1978 | Hess et al. | 416/190 |

FOREIGN PATENT DOCUMENTS

| | | | |
|---|---|---|---|
| 1300346 | 7/1969 | Fed. Rep. of Germany | 416/193 A |
| 1259750 | 1/1972 | United Kingdom | 416/193 A |

*Primary Examiner*—Everette A. Powell, Jr.
*Attorney, Agent, or Firm*—Charles A. Warren

[57] ABSTRACT

A damper for damping the vibration of blades in a turbine rotor including a plate having at least one bumper extending outwardly from one side of the plate to be positioned in recesses on the underside of the platforms on adjacent blades for locating the bumper circumferentially and with a tab extending inwardly from the plate on the side opposite to the bumper to hold the damper in radial position. A wear strip extending upwardly from the plate near its periphery serves as a seal to minimize gas leakage past the damper.

6 Claims, 4 Drawing Figures

BLADE DAMPER SEAL

DESCRIPTION

1. Technical Field

The invention relates to blade dampeners and seals for use in gas turbines particularly in high performance engines for aircraft.

2. Background Art

Blade dampers for the rotors of turbine engines have been positioned between the groups of adjacent blades and serve to damp the vibration of the individual blades. The dampers have been routinely made relatively thick resulting in a very stiff design. This stiffness frequently prevents the damper from full contact with the blade platforms thereby reducing the effectiveness of the damping action. It is also desirable to use these dampers as seals to minimize leakage between adjacent platforms from within the rotor. A full contact between the damper and blade platforms is necessary to obtain the most effective sealing against air leakage.

DISCLOSURE OF INVENTION

A feature of the invention is a damper with much greater flexibility permitting it to deform under load for a better contact with the blade platforms.

Another feature is a multipiece bumper on the damper in order not to diminish the flexibility of the damper to improve its sealing action.

Another feature is the use of wear strips on the damper on the surfaces adjacent the blade platforms to assure more complete contact between the damper and the platform for effectively minimizing leakage.

According to the invention the damper extends axially of the rotor between adjacent blades and has laterally extending flanges to engage with the underside of the blade platforms. The damper has one or more short bumper elements on its outer surface to extend into a recess formed on the underside of the platforms of adjacent blades. If there is no more than one of these bumpers, they are axially spaced apart and relatively short in axial dimension in order not to diminish the damper flexibility. To minimize air leakage past the damper, the flanges on the damper which in effect form the main plate of the damper carry narrow integral wear strips for direct engagement with the blade platforms. These strips will in use wear down until there is full lengthwise contact between these strips and the associated platforms. In addition the damper has a projecting tab that closely engages the disk periphery to hold the damper radially in position and the damper length is closely matched to the axial spacing between a lug on the blade and a cover plate on the disk to retain the damper in precise axial position within the rotor.

The foregoing and other objects, features and advantages of the present invention will become more apparent in the light of the following detailed description of the preferred embodiments thereof as shown in the accompanying drawing.

BEST MODE FOR CARRYING OUT THE INVENTION

Figure 1:
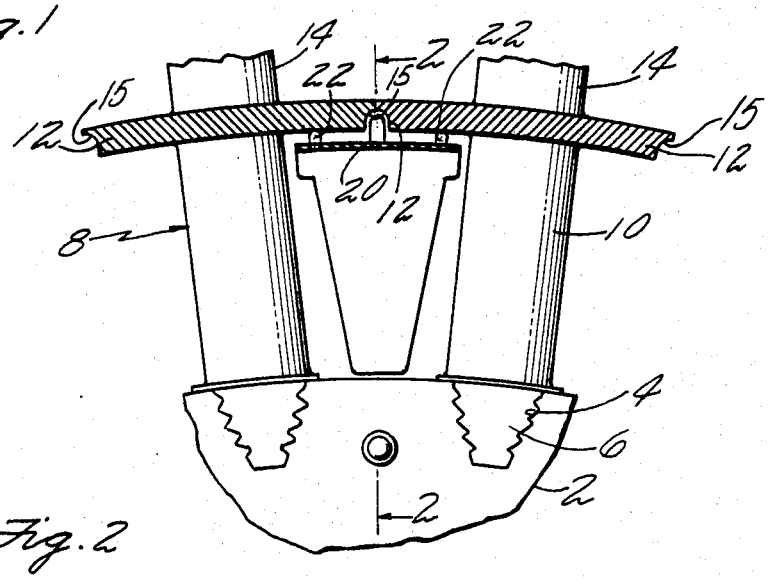
FIG. 1 is a transverse sectional view through the damper and associated blade.
Figure 2:
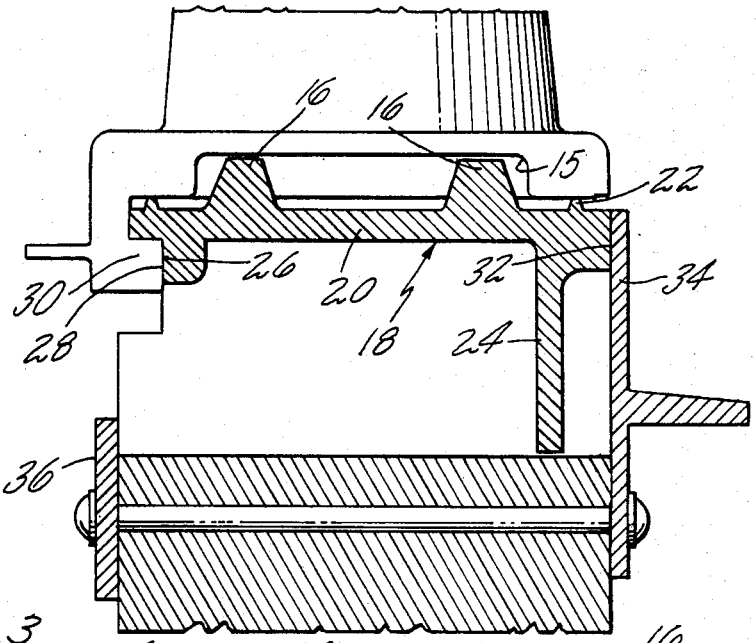
FIG. 2 is an axial sectional view along the line 2—2 of FIG. 1.
Figure 3:
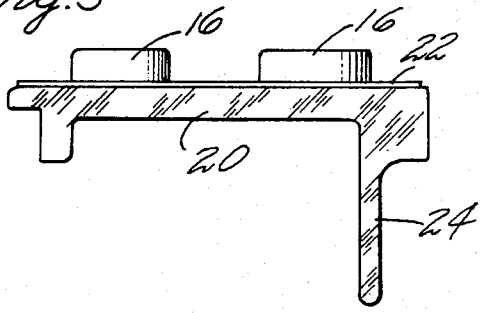
FIG. 3 is a side elevation of the damper removed from the rotor.

A rotor to which the damper is applied includes a disk 2 having slots 4 in the periphery to retain the roots 6 of blades 8 therein. Each of the blades has a stem 10 extending from the root outwardly to a platform 12 and the airfoil portion 14 of the blade extends radially outward from the platform. The under surfaces of the platform are smooth.

Adjacent blade platforms have cooperating recesses 15 on the underside of the platforms large enough to receive the projecting bumpers 16 on the damper 18. Above the recess the platforms are close to or in contact with one another, as shown. The damper is essentially a plate 20 with sufficient width circumferentially to overlie the platforms of adjacent blades and this plate carries the spaced apart bumpers in alignment with one another midway of the width of the plate. Although a plurality of bumpers are described it will be obvious that in many instances a single bumper may be adequate for retaining the damper in position.

Extending around the periphery of the plate is a wear strip 22 in a position to engage the undersides of the platforms and to prevent leakage between the platforms and the plate. This rib or wear strip is relatively thin and also relatively narrow in a circumferential direction and after several hours of operation of the rotor, the surface of this strip will wear against the blade platforms until the strip is in complete contact substantially over its entire surface with the platforms.

Figure 4:
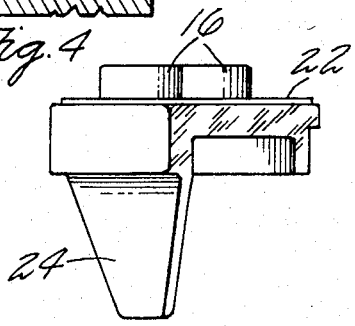
FIG. 4 is a perspective view of the damper.

As will be apparent from FIG. 4 the damper is longer axially of the rotor than the circumferential dimension so that the width of the plate is hereafter intended to mean the circumferential dimension of the plate whereas the length of the plate is intended to define the axial dimension. The plate has longitudinal edges extending axially of the damper.

The spaced apart bumpers do not diminish the flexibility of the damper and the relatively thin plate makes the damper flexible enough so that it may be deformed by centrifugal force as the device operates to assure contact with the wear strip over the entire area. The bumpers are relatively small in an axial direction thereby not diminishing the ability of the damper to deform for more complete contact with the blade platforms. A relatively small number of bumpers are used in order to reduce the total effective length of the bumpers thereby assuring the desired flexibility.

The damper has an inwardly extending tab 24 that reaches nearly into contact with the periphery of the rotor and this serves to hold the damper in radial position. The damper also has a precision surface 26 adjacent one end in a position to engage a cooperating surface 28 on an inwardly projecting lug 30 on the blade to limit axial movement of the damper in one direction. Another precision surface 32 properly spaced from the surface 26 is in a position to be engaged by an end plate 34 on the rotor. This plate in cooperation with the lug on the blade defines the precise axial location of the damper within the rotor. The blades are held in axial position by the above-mentioned end plate and a cooperating end plate 36 on the other side of the rotor.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A damper for damping of blades in a turbine engine rotor, the damper including:

a thin flexible plate having spaced longitudinal edges;

at least one small bumper extending upwardly from one side of the plate and located midway of its width, said bumper having a small dimension both longitudinally and transversely of the plate;

thin wear strips extending upwardly from the plate on the same side as the bumper, said strips being spaced apart and being spaced from and closely adjacent to the opposite longitudinal edges of the plate; and a depending tab extending from the plate on the side opposite to the bumper and precision surfaces adjacent each end of the plate for locating the plate with respect to the blades.

2. A damper as in claim 1 in which each wear strip is narrow to improve flexibility of the damper and wear on the plate.

3. A damper as in claim 1 in which there are a plurality of short bumpers which are in alignment longitudinally of the plate and also spaced apart in this direction.

4. In a blade damping assembly the combination with:

a rotor having a disk blades secured in the disk and extending outwardly therefrom, said blades platforms spaced from the periphery of the disk, said platforms having recesses on the underside, the adjacent blades being spaced apart circumferentially and each platform having an inwardly extending lug; and an end plate on one side of the disk;

of a damper including;

a plate positioned between adjacent blades and radially inward of the spaced blade platforms said plate having spaced longitudinal edges;

at least one short bumper extending outwardly from the plate and located in the recesses on the undersides of adjacent platforms;

a tab extending radially inward of the plate substantially to the periphery of the disk and in a radial position to engage the disk; and precision surfaces at opposite ends of the plate, one surface being in an axial position to engage the end plate.

5. An assembly as claim 4 including narrow, thin wear strips on the outer surface of the plate closely adjacent to and spaced from the longitudinal edges to engage the undersides of the platform.

6. An assembly as in claim 4 in which there are at least two axially spaced bumpers in alignment and each is relatively short in an axial direction.

* * * * *

UNITED STATES PATENT AND TRADEMARK OFFICE

CERTIFICATE OF CORRECTION

PATENT NO. : 4,473,337

DATED : September 25, 1984

INVENTOR(S) : Salvatore A. Leonardi et al

It is certified that error appears in the above-identified patent and that said Letters Patent is hereby corrected as shown below:

Col. 3, line 28: after "disk" insert --,--

Col. 4, line 2: after "blades" insert --having--

Col. 4, line 6: after "lug" delete ";" insert --,--

Col. 4, line 21: after "assembly as" insert --in--

Signed and Sealed this

*Twenty-eighth* Day of *May 1985*

[SEAL]

*Attest:*

DONALD J. QUIGG

*Attesting Officer* *Acting Commissioner of Patents and Trademarks*